US012560042B2

(12) United States Patent
Anderson et al.

(10) Patent No.: US 12,560,042 B2
(45) Date of Patent: Feb. 24, 2026

(54) METHANE HYDRATE PRODUCTION EQUIPMENT AND METHOD

(71) Applicant: Baker Hughes Energy Technology UK Limited, Bristol (GB)

(72) Inventors: David A. Anderson, Montrose (GB); Fiona Robertson, Aberdeen (GB); Paul Clark, Aberdeen (GB); Robin Rajan, Bengaluru (IN)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 17/967,624

(22) Filed: Oct. 17, 2022

(65) Prior Publication Data

US 2023/0130315 A1 Apr. 27, 2023

(30) Foreign Application Priority Data

Oct. 27, 2021 (IN) ..... 202111049160

(51) Int. Cl.

| | |
|---|---|
| ***E21B 33/038*** | (2006.01) |
| ***E21B 33/043*** | (2006.01) |
| ***E21B 34/04*** | (2006.01) |
| ***E21B 41/00*** | (2006.01) |
| ***E21B 41/04*** | (2006.01) |

(52) U.S. Cl.

CPC ..... *E21B 33/038* (2013.01); *E21B 33/043* (2013.01); *E21B 34/04* (2013.01); *E21B 41/0099* (2020.05); *E21B 41/04* (2013.01)

(58) Field of Classification Search

CPC .. E21B 33/038; E21B 41/0099; E21B 33/043; E21B 34/04; E21B 41/04

See application file for complete search history.

(56) References Cited

U.S. PATENT DOCUMENTS

| | | | | |
|---|---|---|---|---|
| 4,552,213 A * | 11/1985 | Boyd | E21B 33/047 166/88.4 |
| 6,688,386 B2 | 2/2004 | Cornelssen | |
| 6,715,554 B1 * | 4/2004 | Cunningham | E21B 33/047 166/368 |
| 6,913,083 B2 * | 7/2005 | Smith | E21B 47/12 166/344 |

(Continued)

FOREIGN PATENT DOCUMENTS

| | | |
|---|---|---|
| EP | 0885345 A1 | 12/1998 |
| JP | 2000517013 A | 12/2000 |
| JP | 2019504223 A | 2/2019 |

OTHER PUBLICATIONS

Yamamoto et al., "Well design for methane hydrate production: developing a low-cost production well for offshore Japan," Offshore Technology Conference Asia, Mar. 2018, 8 pages.

(Continued)

*Primary Examiner* — Aaron L Lembo

(74) *Attorney, Agent, or Firm* — Hogan Lovells US LLP

(57) ABSTRACT

A system for subsea operations and associated methods are disclosed. The system includes a well adapter to be associated with a production or monitoring well where the well adapter can receive a cap for capping the production or monitoring well and can receive a valve package to allow flow of production fluids therethrough, from the production well to the well adapter.

20 Claims, 9 Drawing Sheets

(56) References Cited

U.S. PATENT DOCUMENTS

| | | | | |
|---|---|---|---|---|
| 7,165,619 | B2 * | 1/2007 | Fox | E21B 19/146 166/77.2 |
| 7,331,394 | B2 * | 2/2008 | Edwards | E21B 33/076 166/365 |
| 7,677,320 | B2 | 3/2010 | Shaw | |
| 8,316,946 | B2 * | 11/2012 | June | E21B 33/047 166/344 |
| 8,322,442 | B2 * | 12/2012 | Voss | E21B 43/121 166/344 |
| 8,960,302 | B2 * | 2/2015 | Shilling | F04B 17/02 166/345 |
| 8,997,872 | B1 | 4/2015 | Lugo | |
| 9,309,740 | B2 * | 4/2016 | June | E21B 33/0353 |
| 9,631,460 | B2 * | 4/2017 | June | E21B 43/013 |
| 9,650,855 | B2 * | 5/2017 | Caldwell | E21B 33/038 |
| 9,784,063 | B2 * | 10/2017 | June | E21B 33/035 |
| 9,874,065 | B2 * | 1/2018 | Christensen | E21B 43/128 |
| 9,874,076 | B2 * | 1/2018 | Christensen | E21B 33/035 |
| 9,909,380 | B2 * | 3/2018 | June | E21B 33/035 |
| 10,036,226 | B2 * | 7/2018 | Maher | E21B 43/013 |
| 10,240,424 | B2 * | 3/2019 | Brown | E21B 33/035 |
| 10,337,276 | B2 * | 7/2019 | Powell | E21B 33/043 |
| 10,968,707 | B2 * | 4/2021 | Billington | E21B 19/002 |
| 11,047,198 | B2 * | 6/2021 | Ross | E21B 33/0407 |
| 11,125,041 | B2 * | 9/2021 | Bay | E21B 33/04 |
| 11,136,857 | B2 * | 10/2021 | Cramm | E21B 33/061 |
| 11,142,983 | B2 * | 10/2021 | Thomas | E21B 34/04 |
| 11,767,754 | B2 * | 9/2023 | Kalb | E21B 33/043 166/335 |
| 11,773,678 | B2 * | 10/2023 | Bartlett | E21B 33/0355 166/344 |
| 11,846,162 | B2 * | 12/2023 | Jonsjord | E21B 33/0355 |
| 2002/0011336 | A1 | 1/2002 | Baskett et al. | |
| 2004/0112604 | A1 | 6/2004 | Milberger et al. | |
| 2005/0028980 | A1 * | 2/2005 | Page | E21B 33/1294 166/373 |
| 2007/0246220 | A1 | 10/2007 | Fenton | |
| 2012/0043089 | A1 * | 2/2012 | Hoffman | E21B 33/064 166/365 |
| 2012/0318520 | A1 * | 12/2012 | Lugo | E21B 21/001 166/363 |
| 2014/0251633 | A1 | 9/2014 | Dahlem et al. | |
| 2015/0047850 | A1 * | 2/2015 | Johnson | E21B 43/12 166/54.1 |
| 2015/0330194 | A1 * | 11/2015 | June | E21B 43/128 166/351 |
| 2018/0209236 | A1 * | 7/2018 | Talgø | E21B 23/14 |
| 2019/0226303 | A1 * | 7/2019 | Billington | E21B 43/01 |

OTHER PUBLICATIONS

Yamamoto et al., "Construction process of a low-cost subsea well for methane hydrate production in nankai trough," 27th Ocean Engineering Symposium, Aug. 2018, 7 pages.

International Search Report and Written Opinion issued in PCT Application No. PCT/EP2022/025484, mailed Mar. 6, 2023 (15 pages).

* cited by examiner

METHANE HYDRATE PRODUCTION EQUIPMENT AND METHOD

CROSS-REFERENCES TO RELATED APPLICATIONS

This application is related to and claims the benefit of priority from Indian Non-Provisional Patent Application 202111049160, titled METHANE HYDRATE PRODUCTION EQUIPMENT AND METHOD, filed Oct. 27, 2021, the entire disclosure of which is incorporated by reference herein for all intents and purposes.

BACKGROUND

1. Field of the Invention

The present disclosure relates to a system and method for performing methane hydrate operations. More specifically, the present disclosure relates to tool assemblies to be used in subsea environments and for methane hydrate production equipment and method.

2. Description of Related Art

As part of drilling in subsea formations for methane hydrate operations, there may be a requirement for using a subsea test tree and blow out prevent (BOP) stack. Such a requirement may limit open water completion systems.

SUMMARY

In one embodiment, a system for subsea operations is disclosed. The system includes a well adapter to be associated with a production or monitoring well. The well adapter is to receive a cap for capping the production or monitoring well and is to receive a valve package to allow flow of production fluids therethrough, from the production well to the well adapter.

In one embodiment, a well adapter for subsea operations is disclosed. The well adapter is to be associated with a production or monitoring well. The well adapter is to receive a cap for capping the production or monitoring well and is to receive a valve package to allow flow of production fluids therethrough, from the production well to the well adapter In at least one embodiment, a method for subsea operations is disclosed. The method includes enabling a well adapter to be associated with a production or monitoring well. The method also includes associating a cap or a valve package with the well adapter. The cap is to allow capping of the production or monitoring well and the valve package is to allow flow of production fluids therethrough, from the production well to the well adapter.

BRIEF DESCRIPTION OF DRAWINGS

Various embodiments in accordance with the present disclosure will be described with reference to the drawings, in which.

DETAILED DESCRIPTION

Figure 1:
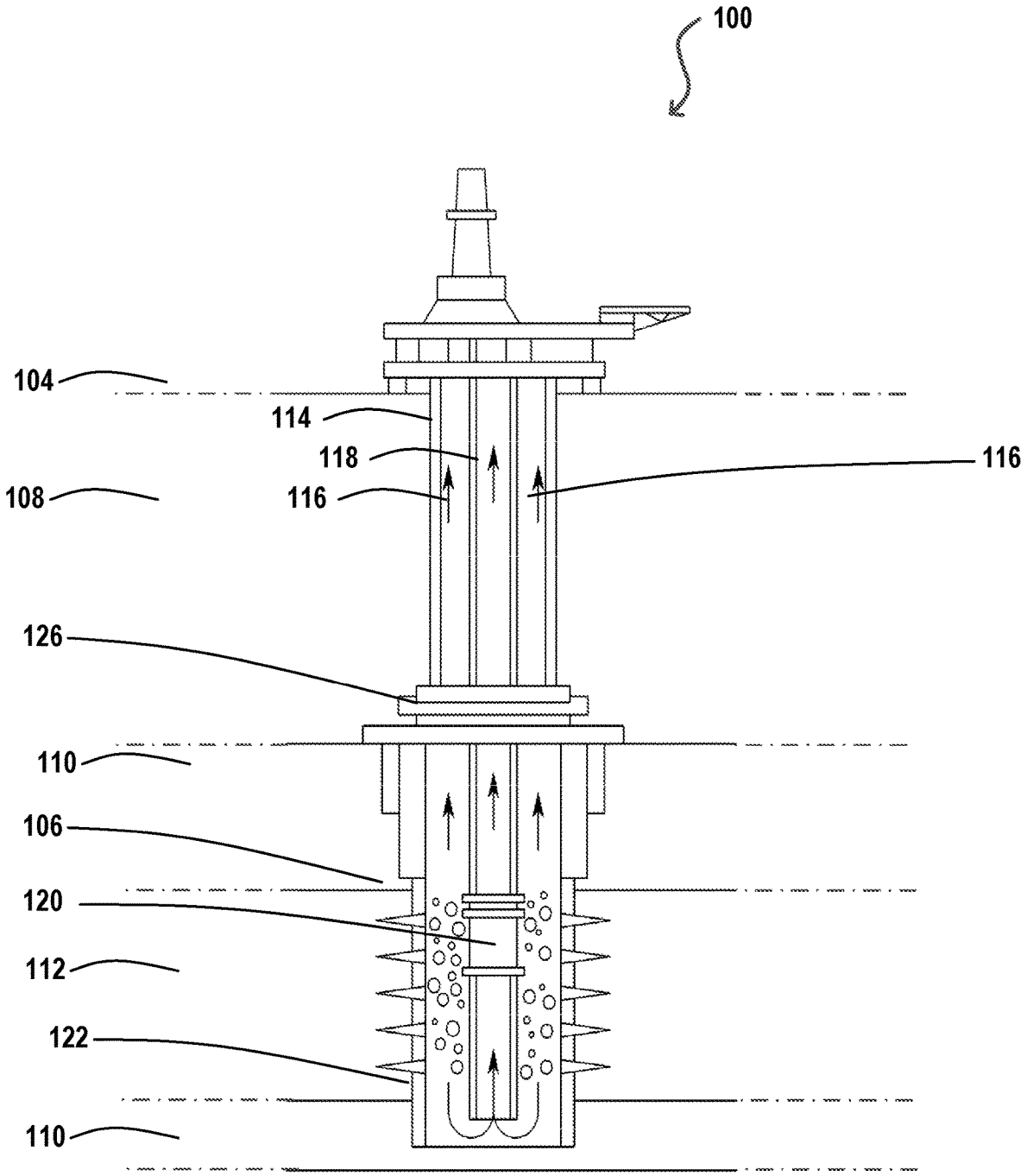
FIG. 1 is a schematic view of a system for performing methane hydrate operations subject to improvements, in accordance with embodiments of the present disclosure.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least one embodiment, the present disclosure is to a system and a method associated with a system for subsea operations that includes a well adapter.

In at least one embodiment, a system for subsea operations that includes a well adapter may be associated with a method for installing the system. The system and method are associated with methane gas extraction from methane hydrate sources. There may be multiple methods for installing the system, where the multiple methods, may include specific installation sequences to arrive at a system for subsea operations that includes a well adapter. Once installed, the system for subsea operations that includes a well adapter is associated with a well or a wellhead that is either a production or a monitoring well. The production well is a well that produces methane gas from methane hydrate sources.

Methane hydrate sources generally include subsea areas having methane gas surrounded by ice. Methane gas is a useful fuel that is colourless, odourless, and combustible. In at least one embodiment, such methane gas may be produced by bacterial decomposition of plant and animal matter and may be formed in a process shared by all fossil fuels. The hydrate aspect of the methane hydrate sources may be in reference to a substance that contains water. For example, methane does not bond chemically with the water. Instead, each tetrahedral methane molecule may sit within a crystalline shell made of ice. The substance is therefore referred to as methane hydrate and its subsea sources may be methane hydrate sources.

In at least one embodiment, an installation sequence includes running tubing in open water. The well adapter may be installed with a tubing associated with it, may be installed without a tubing where a stab connection is provided to a tubing hanger, or may be installed with a tubing hanger associated with it. In at least one embodiment, such a system for subsea operations that includes a well adapter addresses issues where a subsea test tree (SSTT) or simplified landing string (SLS) equipment may be otherwise required. As such, a system for subsea operations that includes a well adapter removes a requirement for using a subsea test tree and BOP and replaces such a requirement with an open water completion system so that the open water completion system can be used on other projects.

In at least one embodiment, the installation sequence provides a seal in a wellhead with tubing hanger associated with the well adapter prior to being associated the wellhead, during one installation sequence. This installation sequence occurs in running open water and saves the BOP and SSTT that would otherwise be required for installation of a tubing hanger. In at least one embodiment, such an installation that removes the need for using a BOP, an SSTT, or an SLS improves installation time by reducing a number of trips required to install a system to perform methane gas extraction from methane hydrate sources.

FIG. 1 is a schematic view of a system 100 for performing methane hydrate operations subject to improvements, in accordance with embodiments of the present disclosure. The system 100 may include a rig 102 on a sea surface 104, with a production well 106 below it, in a subsea environment 108. A drill string may be used to drill through one or more sediment layers 110, where a methane hydrate layer 112 may be sandwiched there between or may exist below one or more of such methane hydrate layers 112.

A production tubing or riser 114 may be provided after the drilling to include sections multiple tubing 116, 118 therein. In at least one embodiment, the production tubing 114 may have an inner section 116 for methane gas flow and may have an inner tubing 118 for water flow, from the production well 106 to the rig 102. The production tubing 114 may be formed from one or more tubulars that are mechanically coupled together (e.g., via threads, specialty couplings, or the like). The inner tubing 118 extends from the production tubing 114 to the production well 106. The inner section 116, therefore, also extends from the production tubing 114 to the production well 106. Further, the production well 106 is supported by a production casing 122 that is provided within a bore to prevent collapse of the bore.

In at least one embodiment, the system 100 includes an electric submersible pump (ESP) 120 installed within the production well 106 or as close to at least one methane hydrate layer 112 as possible. The methane hydrate layer may be about 1.3 kilometers below the sea surface 104 and may be sandwiched between multiple sediment layers 110. Pressure and temperature sensors may be used to ensure that a determined pressure and temperature is achieved for the methane hydrate layer 112 so that methane gas and water can enter into the production well 106, such as through perforations or entry points on the production well 106.

In at least one embodiment, water is pumped up the well through an inner tubing 118 using the ESP 120. Pressure in the methane hydrate layer is therefore reduced. Then, methane hydrate deposits may disassociate into methane gas at the production well 106 area and may rise from the water through the inner section 116 of the production well 106 and of the production tubing 114. As a result, both methane gas and water, which are disassociated from the methane hydrate flow up tot the rig 102. The methane gas may be therefore extracted in this manner.

Figure 2:
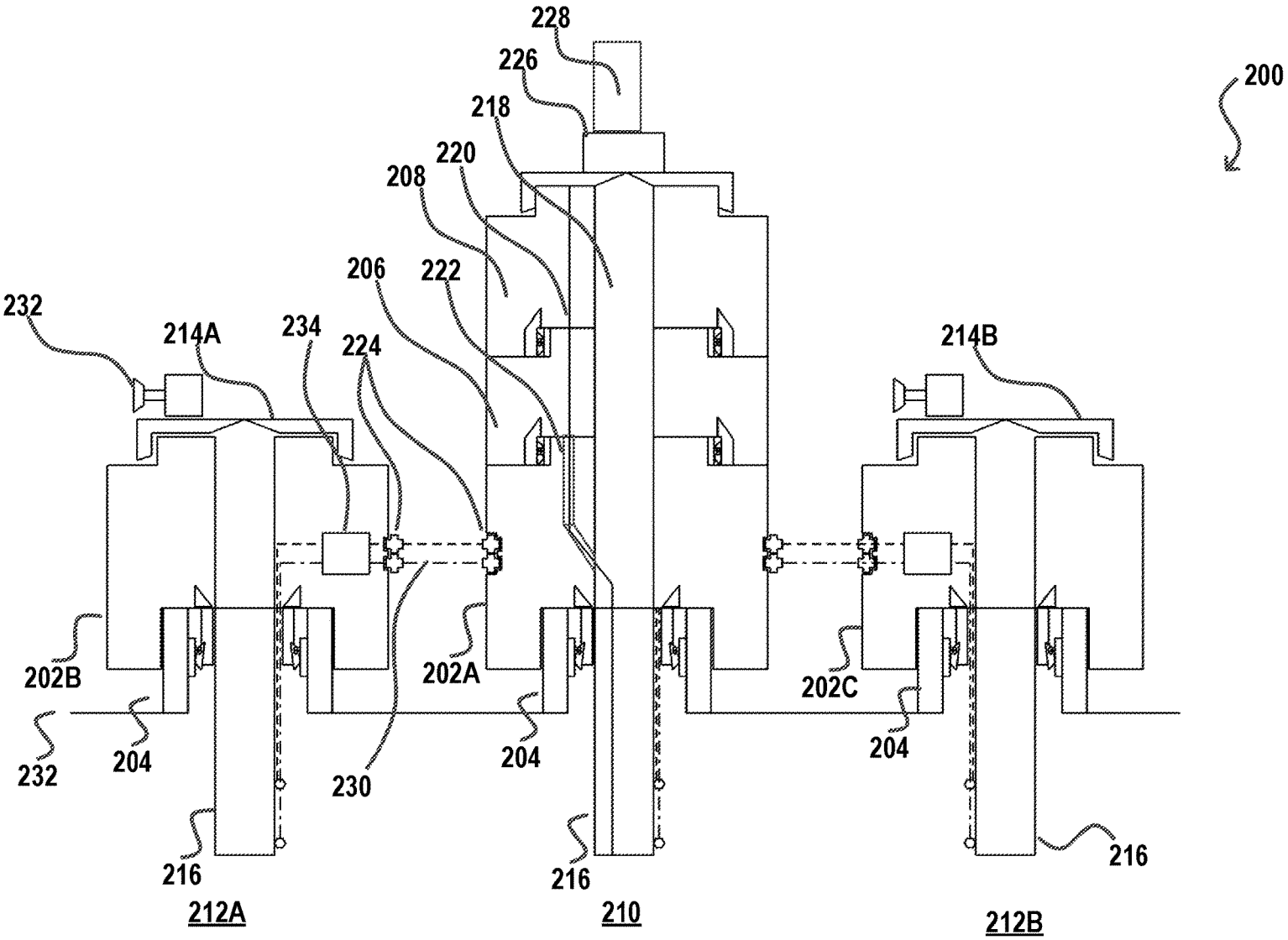
FIG. 2 illustrates a system for subsea operations that includes a well adapter and valve package having a well control package (WCP), according to at least one embodiment.

FIG. 2 illustrates a system 200 for subsea operations that includes a well adapter 202A; 202B; 202C that may be associated with each production and monitoring well. Further, a valve package, such as well control package (WCP) 206, 208, may be associated with at least the production well 210, according to at least one embodiment. Three well adapters 202A, 202B, 202C are therefore illustrated, with one well adapter 202A being associated with a production well 210 and the two other well adapters 202B, C being associated with monitoring wells 212A, B. Each well adapter 202A; 202B; 202C may be associated with a respective production or monitoring well 210; 212A; 212B by a placement over a respective wellhead 202A; 202B; 202C, which is, in turn, over a production casing 216. The wellhead 204 may be at a sediment surface 232 and may be high pressure production wellhead.

Each well adapter 202; 204A; 204B may be adapted to receive a cap or to receive a valve package, such as a WCP or a Christmas tree (also referred to as an Xmas Tree or XT). For example, the monitoring wells 212A, B are illustrated as having a received a respective cap 214A, B for capping the monitoring well, which the production well 210 is illustrated as having received a valve package in the form of a WCP 206, 208, where such a WCP is formed of a combination of a lower riser package (LRP) 206 and an emergency disconnect package (EDP) 208. The well adapter 202 can allow flow of production fluids through the well adapter 202, from the production well 210 to the valve package, such as a WCP 206, 208.

In at least one embodiment, the cap 214A, B is a corrosion or debris cap to prevent corrosion or debris from components of the well adapter or the production or monitoring well 210, 212A, B, generally. Further, there may be access ports 224 in the well adapters 202, 204A, B to allow communication equipment, downhole pressure transducers (DHPTs), or monitoring equipment to access the production or monitoring well 210, 212A, B. Such access ports 224 may be used for intervention fluids as well.

In at least one embodiment, a passthrough feature 222 of a well adapter 202 can allow water to flow independent of gas from a methane hydrate layer of the production or monitoring well. For example, the gas flows from the methane hydrate layer, through the production casing 216, through a main bore 218 of the well adapter 202, through the WCP 206, 208, and to a riser 228 associated with a stress joint connector 226, before terminating at a rig at a sea surface.

In at least one embodiment, the access ports of the production well 210 and of the monitoring wells 212A, B may be associated together using flying leads 230 so that controls may be commonly provided to a selected well 210; 212A; 212B. The controls may be on an interface 234 that can be accessed and controlled by a remotely operated vehicle (ROV), such as illustrated in at least FIG. 3 herein. In at least one embodiment, however, the flying leads 224 may be used to provide communication via communication equipment or monitoring signals via monitoring equipment to a select well by activating or deactivating access ports 224.

In at least one embodiment, intervention fluids may be provided to a select well by shutting off an access port of an unintended well, but by using the same flying leads 230. Further, the cap 214A; B used with the well adapter 204A; B may have a test port 232 for testing of a temperature and pressure of a monitoring well. In at least one embodiment, the cap 214A; B may be removed and a WCP 206, 208 may be placed to convert a monitoring well to a production well. In the same vein, a production well may be capped to convert a production well to a monitoring well.

Figure 3:
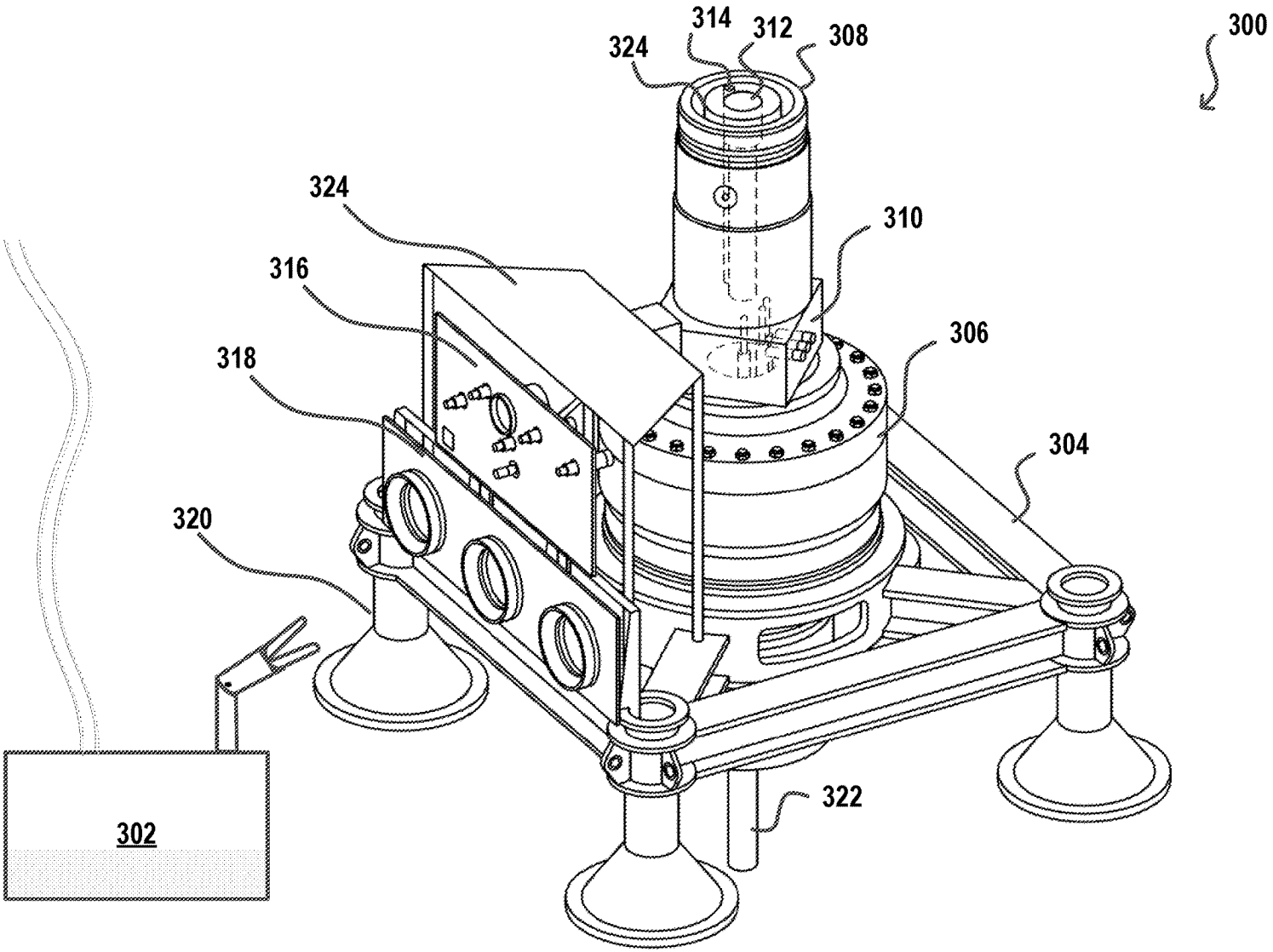
FIG. 3 illustrates details of a well adapter for subsea operations, according to at least one embodiment.

FIG. 3 illustrates details of a well adapter 300 for subsea operations, according to at least one embodiment. The well adapter 300 is illustrated in a perspective view to show an alignment frame 304 that supports a wellhead coupler 306 and a WCP coupler 308. The WCP coupler 308 includes a main bore 324 that further includes a passthrough 314 for water and a main bore 312 for gas flow. The alignment frame 304 includes guide funnels 320 for orientation to a wellhead. A dropped object protection 324 is provided for aspects of the access ports. Further, access ports 318 (also referred to as a penetrator) allows cables for communication and monitoring there through. The access ports 318 can also support a DHPT snaked through to reach the production or monitoring well.

In at least one embodiment, the controls 316 of the well adapter 300 is on a ROV panel. The controls 316 can include support hydraulic functions using hot stab connections controlled by an ROV 302. Further, the access ports 318 can support a subsea umbilical from a sea surface, for the monitoring wells, and can support flying leads to the monitoring wells. Further, the well adapter 300 can include an adapter tubing associated with it for a stab connection with a wellhead or with production casing within the wellhead.

Figure 4:
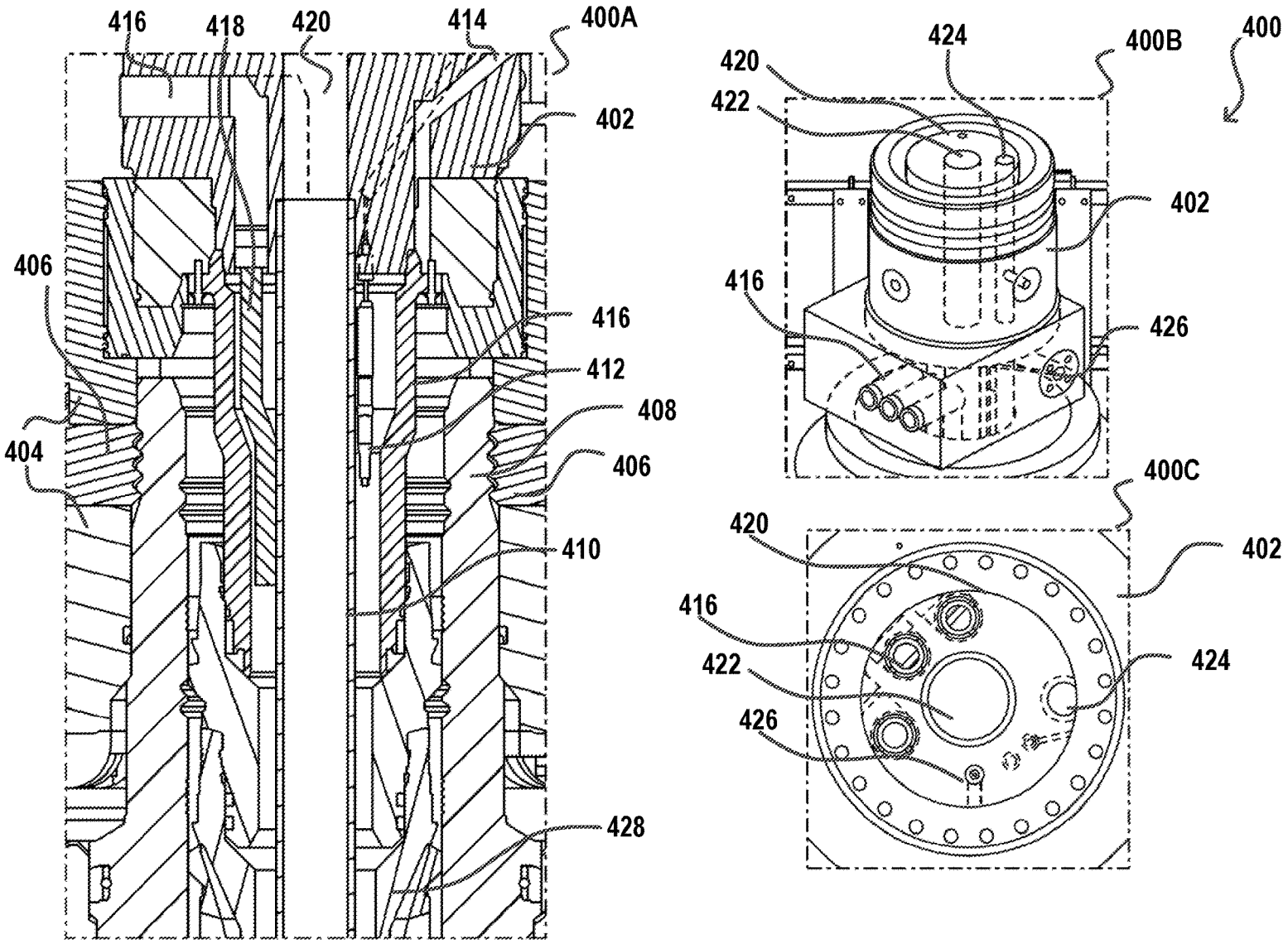
FIG. 4 illustrates further details, in different views of a system for subsea operations that includes a well adapter, according to at least one embodiment.

FIG. 4 illustrates further details 400, in different views 400A, B, C of a system for subsea operations that includes a well adapter, according to at least one embodiment. In a first cutaway side view 400A, a bottom of a WCP coupler 402 of the well adapter is illustrated as it is coupled to wellhead coupler 404 of the well adapter. The wellhead coupler 404 is illustrated as formed of two exterior sleeves coupled together and having dogs 406 within one or more of such sleeves. The dogs 406 may be caused to tighten against grooves of an outer diameter of a production wellhead housing 408. This allows for a quick and easy coupling between the well adapter and the production wellhead housing 408. A production casing with a casing hanger 428 may be within a wellhead housing 408. Further, an interior sleeve 416 may be provided for coupling around a production casing.

In at least one embodiment, an adapter tubing 410 is provided with the well adapter for a stab connection within a wellhead housing 408 or to be within the production casing in the wellhead housing 408. An access port 414 of the well adapter allows for a DHPT 412 to access the production or monitoring well. A further access port or penetrator 416 of the well adapter allows for cabling association with communications or monitoring equipment to access the production or monitoring well. The cabling may be therefore fiber optic or electrical cabling.

A perspective view 400B and a plan view 400C illustrate further details of a WCP coupler 402 that may have interior and exterior coupling features, such as threads or J-slots. The access ports 416 are illustrated at a side of the well adapter that may be for an umbilical from a sea surface (such as, from a rig) and/or for flying leads from neighboring well adapters. In at least one embodiment, ROV hot stabs may be provided to save some of the access ports having flying leads. The main bore 420 is illustrated with the adapter tubing 422 for production gases (such as, methane) and a passthrough 424 for water from a methane hydrate layer. A further access port 426 is illustrated in the views 400B, C for the DHPT 412 tool.

In at least one embodiment, an open water intervention riser system (OWIRS) may be used with the well adapter. An OWIRS may not require fibre optic connection or cabling, so separate umbilical may be provided for the well adapter. This separate umbilical can contain the necessary fiber optic and electrical connections to operate methane hydrate extraction. An OWIRS umbilical for operating an OWIRS may include 15 hydraulic lines and 2 electrical lines.

Figure 5:
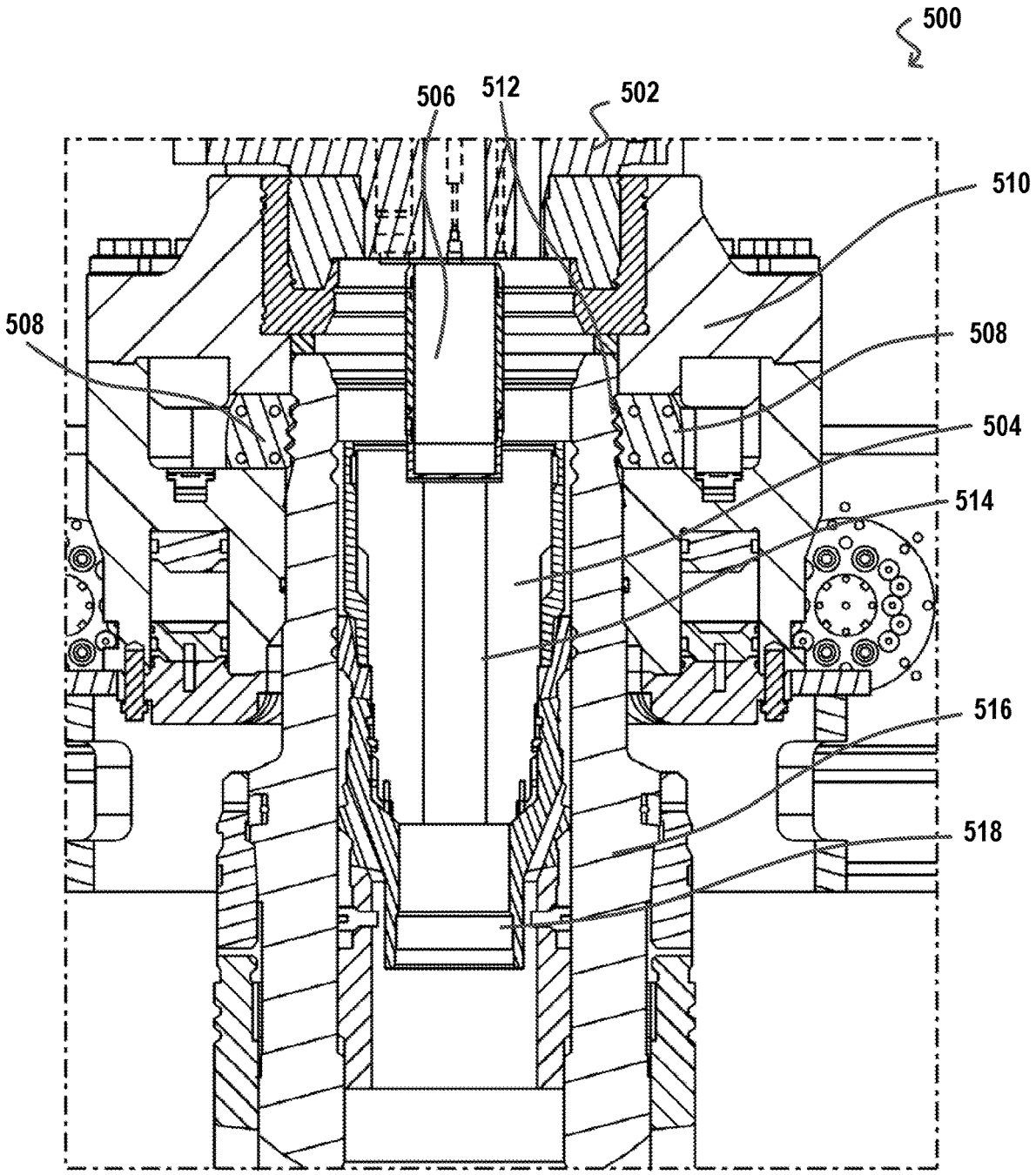
FIG. 5 illustrates association details of a system for subsea operations that includes a well adapter, according to at least one embodiment.

FIG. 5 illustrates association details of a system 500 for subsea operations that includes a well adapter, according to at least one embodiment. The system 500 may include a tubing hanger 504 coupled within a wellhead housing 516 and that may be coupled to a production casing. A tubing adapter 506 may be within a wellhead coupler 510 of a well adapter and may be coupled to the tubing hanger 504. Both the tubing adapter 506 and the tubing hanger 504 can receive a production tubing associated with a valve package, such as an association with a WCP coupler of a well adapter 502, which is illustrated, in part, in FIG. 5.

FIG. 5 also illustrates that dogs 508 lock into grooves 512 of the wellhead housing 516 to hold the well adapter in position. An adapter tubing 514 may be enabled by one or more of the well adapter components, such as the tubing hanger 504 or the tubing adapter 506. In at least one embodiment, the tubing hanger 504 is associated with the well adapter and then lowered into a stab connection with the wellhead using an OWIRS so that it is suspended within a production casing. In at least one embodiment, the tubing hanger is first installed in a wellhead using an open water running tool and then the well adapter is deployed via the OWIRS. In at least one embodiment, there may not be a tubing hanger first provided with the production wellhead or with the well adapter, but a production tubing may be subsequently associated with a well adapter, such as discussed in FIG. 3. Then, the well adapter may be deployed so that the production tubing fits by a stab connection 518 into the wellhead 516.

Figure 6:
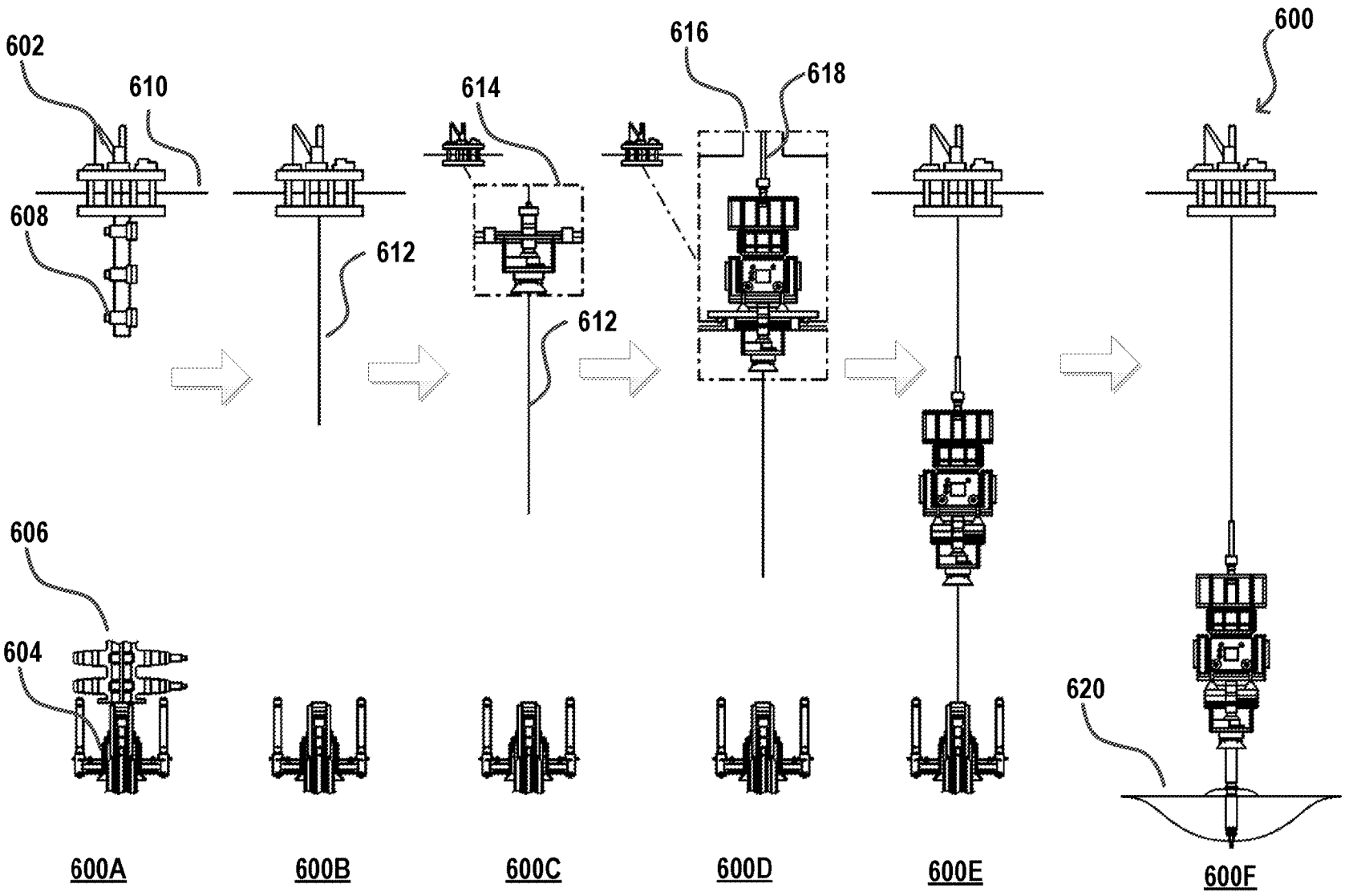
FIGS. 6, 7, and 8 illustrate different installation sequences for a system for subsea operations that includes a well adapter, according to at least one embodiment.
Figure 7:
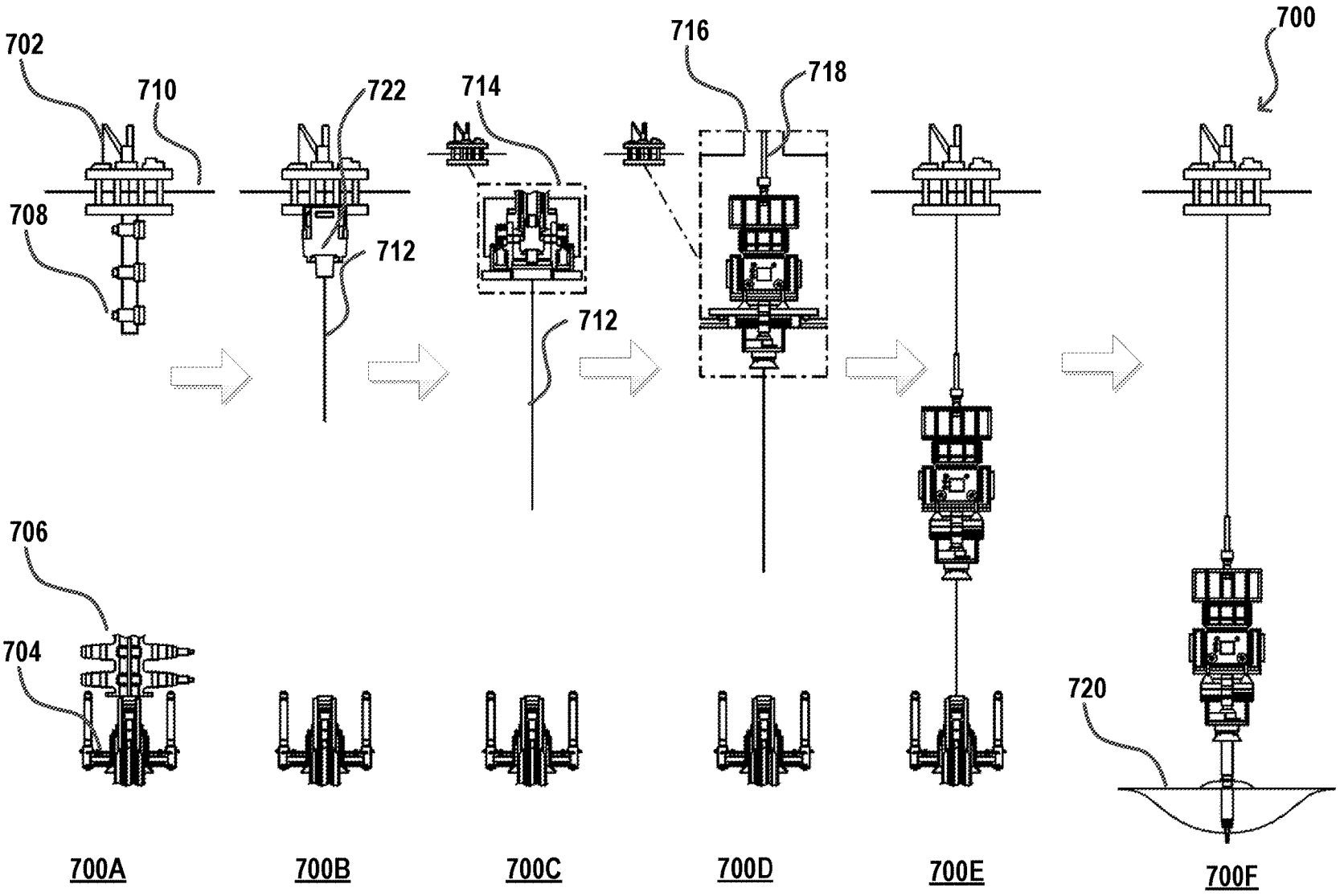
Figure 8:
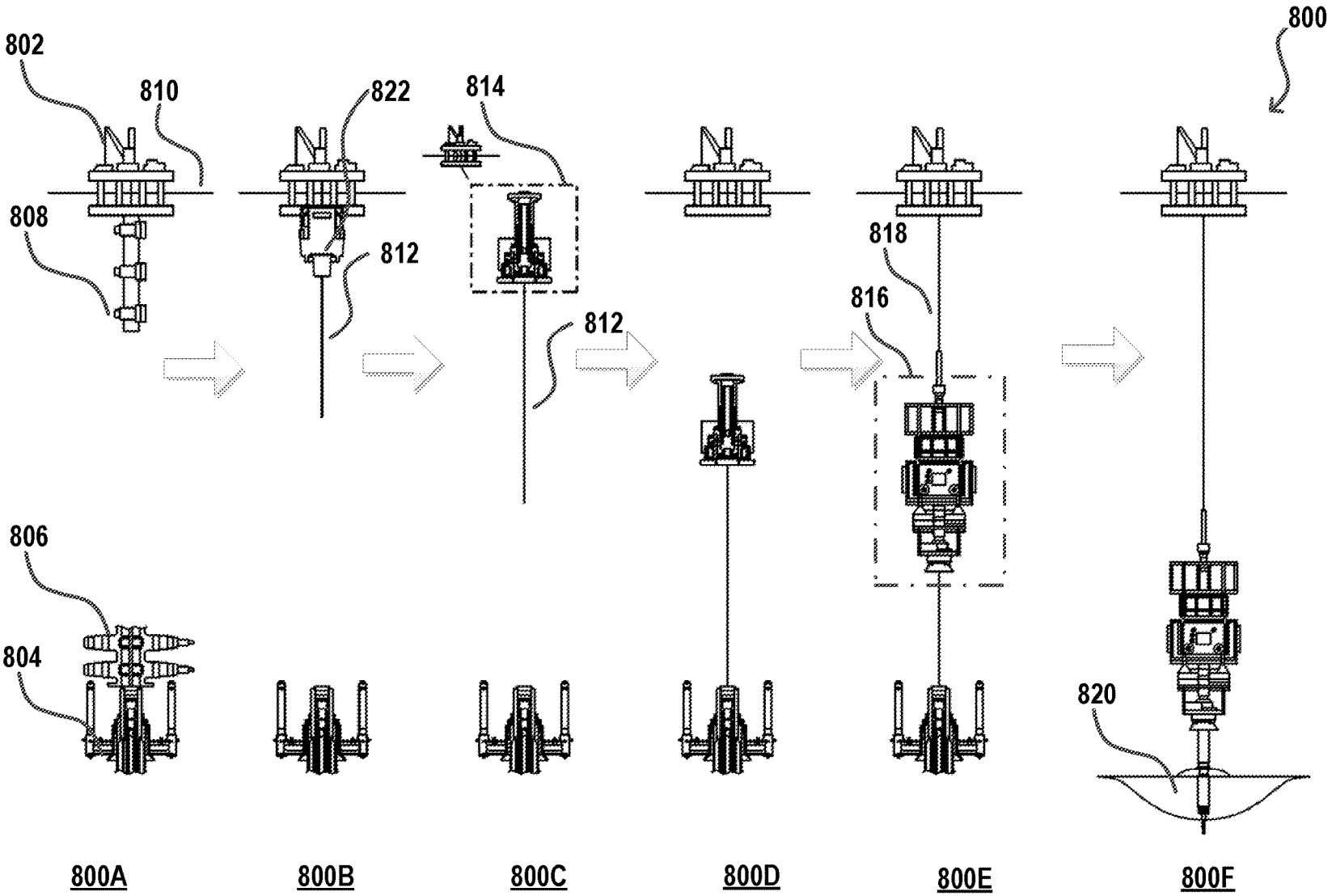

FIGS. 6, 7, and 8 illustrate different installation sequences 600, 700, 800 for a system for subsea operations that includes a well adapter, according to at least one embodiment. Each installation sequence 600; 700; 800 may be independently used to associate a well adapter with a wellhead and a production casing. In at least one embodiment, in a first installation sequence 600, a rig 602 is associated with a moonpool and a drill string 608 there below is used to drill a well to depth, as illustrated in step 600A. Such a drilling feature may be performed using a rig 602, which is supported by a BOP 606 over a wellhead 604. The drilling feature may be controlled and deployed from a rig 602 at a sea surface 610.

A further step 600B of the first installation sequence 600 includes removal of the BOP 606 and running of an ESP completion string or production tubing 612 in an open water configuration and which is suspended in a rotary table. A step 600C of the first installation sequence includes making up a well adapter 614 to the ESP completion string or production tubing 612 in a moonpool of the rig 602. This may be followed by a step 600D for making up an OWIRS to the well adapter (illustrated collectively as block 616) in the moonpool so that the well adapter 614 and the completion string or production tubing 612 are ready for deployment on a riser 618. A step 600E illustrates the deployment of the well adapter and the completion string or production tubing 612 using the OWIRS. A step 600F illustrates a landing and locking step performed for landing and locking the well adapter to the wellhead, which are all ready for methane hydrate production over a sediment layer 720.

In at least one embodiment, in a second installation sequence 700, a rig 702 is associated with a moonpool and a drill string 708 there below is used to drill a well to depth, as illustrated in step 700A. Such a drilling feature may be performed using a rig 702, which is supported by a BOP 706 over a wellhead 704. The drilling feature may be controlled and deployed from a rig 702 at a sea surface 710.

A further step 700B of the second installation sequence 700 includes removal of the BOP 706 and running of an ESP completion string or production tubing 712 in an open water configuration, followed by a making up of a tubing hanger 722, which is suspended in a rotary table. A step 700C of the second installation sequence 700 includes making up a well adapter 714 and the tubing hanger 722 to an ESP completion string or production tubing 712 in a moonpool of the rig 702. This may be followed by a step 700D for making up an OWIRS to the well adapter (illustrated collectively as block 716) in the moonpool so that the well adapter 714, the tubing hanger 720, and the completion string or production tubing 712 are ready for deployment on a riser 718. A step 700E illustrates the deployment of the well adapter, the tubing hanger, and the completion string or production tubing 712 using the OWIRS. A step 700F illustrates a landing and locking step performed for landing and locking the well adapter to the wellhead, which are all ready for methane hydrate production over a sediment layer 720.

In at least one embodiment, in a third installation sequence 800, a rig 802 is associated with a moonpool and a drill string 808 there below is used to drill a well to depth, as illustrated in step 800A. Such a drilling feature may be performed using a rig 802, which is supported by a BOP 806 over a wellhead 804. The drilling feature may be controlled and deployed from a rig 802 at a sea surface 810.

A further step 800B of the third installation sequence 800 includes removal of the BOP 806 and running of an ESP completion string or production tubing 812 in an open water configuration, followed by a making up of a tubing hanger 822, which is suspended in a rotary table. A step 800C of the third installation sequence 800 includes making up an open water running tool to a tubing hanger (illustrated collectively as block 814) and the ESP completion string or production tubing 812 in a moonpool of the rig 802. This may be followed by a step 800D for deploying the tubing hanger using the open water running tool so that the tubing hanger may be installed on the wellhead. A step 800E pertains to deploying the well adapter (illustrated collectively as block 816) via the OWIRS and using a riser 818. A step 800F illustrates a landing and locking step performed for landing and locking the well adapter to the wellhead and the tubing hanger, which are all ready for methane hydrate production over a sediment layer 820.

Figure 9:
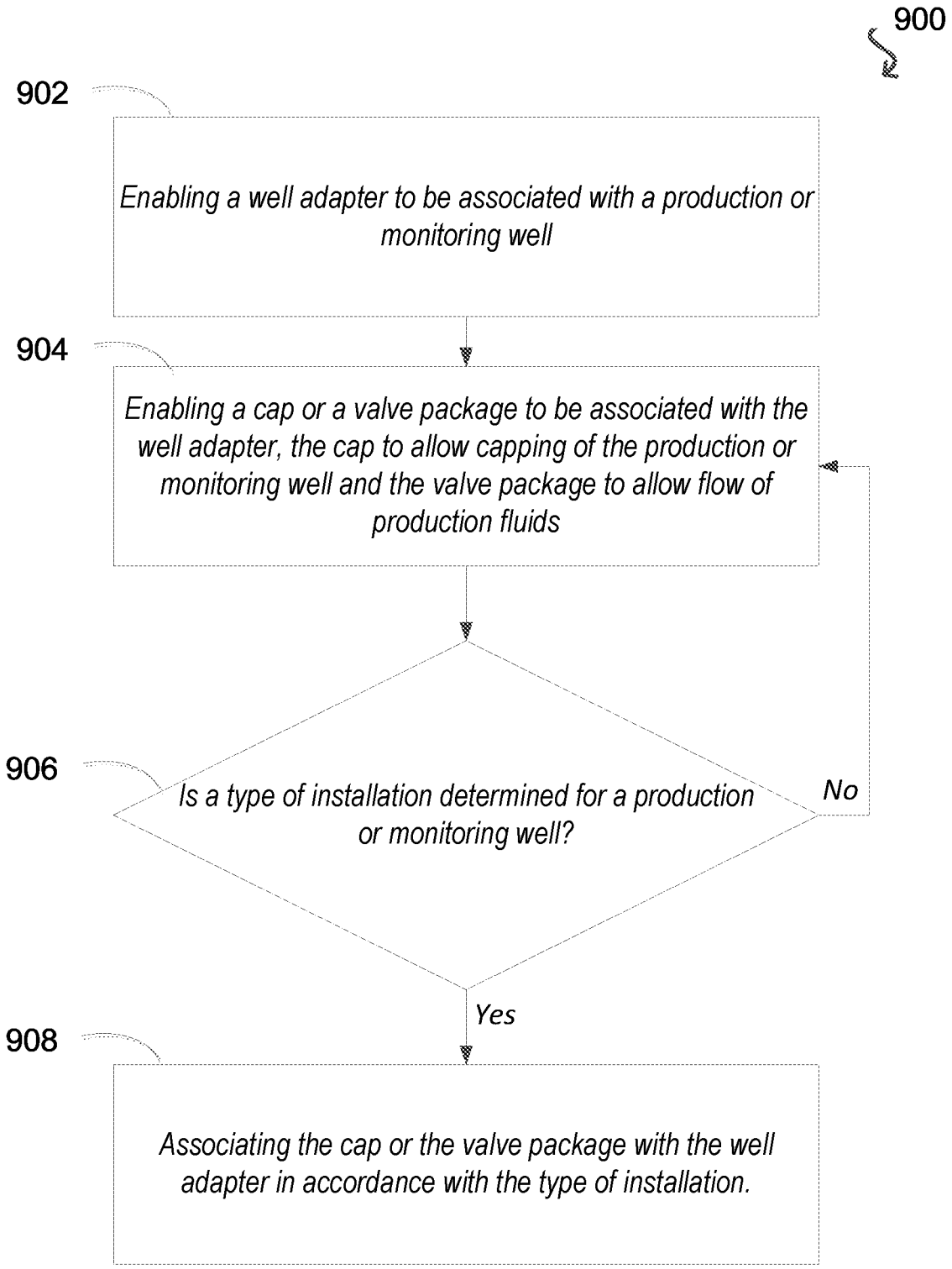
FIG. 9 is a flowchart illustrating a method associated with a system for subsea operations that includes a well adapter, according to at least one embodiment.

FIG. 9 is a flowchart illustrating a method 900 associated with a system for subsea operations that includes a well adapter, according to at least one embodiment. In at least one embodiment, the method 900 includes enabling (902) a well adapter to be associated with a production or monitoring well. A further step of the method includes enabling (904) a cap or a valve package (such as, an Xmas tree or a WCP) to be associated with the well adapter. The cap is provided to allow capping of the production or monitoring well and the valve package is provided to allow flow of production fluids.

In at least one embodiment, a step may be performed for verifying (906) a type of installation that can be determined for a production or monitoring well. In at least one embodiment, a type of installation may be one of the three installation sequences 600, 700, 800 that can be applied to install a well adapter. A step may be performed for associating (908) the cap or the valve package with the well adapter. This allows capping of the production or monitoring well and flow of production fluids there through, from the production or monitoring well to the well adapter.

The method 900 may include a step or a sub-step for forming the valve package using an Xmas tree or a WCP, where the WCP includes one or more of a lower riser package (LRP) and an emergency disconnect package (EDP). In at least one embodiment, the method 900 may include a step or a sub-step for enabling access ports in the well adapter. The access ports can allow communication equipment, downhole pressure transducers (DHPTs), or monitoring equipment to access the production or monitoring well.

In at least one embodiment, the method 900 may include a step or a sub-step for providing a passthrough feature of the well adapter to allow water to flow independent of gas from a methane hydrate layer of the production or monitoring well. In at least one embodiment, the method 900 may include a step or a sub-step for providing the well adapter with an alignment frame that comprises controls for operation by a remotely operated vehicle (ROV).

In at least one embodiment, the method 900 may include a step or a sub-step for enabling a wellhead coupler to be part of the well adapter and to sit over a casing hanger of the production or monitoring well. Then a further step or sub-step may be for providing dogs within the wellhead coupler to lock against grooves of an outer diameter of the wellhead housing.

In at least one embodiment, the method 900 may include a step or a sub-step for associating a tubing with the well adapter. The tubing can, subsequently, be within a casing hanger of the production or monitoring well. In at least one embodiment, the method 900 may include a step or a sub-step for associating a tubing hanger with the wellhead housing of the production or monitoring well. The tubing hanger can receive the well adapter that is stabbed connected using an open water intervention riser system (OWIRS).

In at least one embodiment, the method 900 may include a step or a sub-step for associating a tubing hanger with the adapter and with a tubing, such as a production tubing. The tubing can be, subsequently, within a casing hanger of the production or monitoring well. In at least one embodiment, the method 900 may include a step or a sub-step for providing an isolation sleeve within the well adapter to fit within a wellhead housing of the production or monitoring well.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art and are intended to be encompassed within the spirit of the present disclosure disclosed herein and the scope of the appended claims.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined together, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages, and can be used in a variety of applications. Various embodiments may be combined or modified based in part on the present disclosure, which is readily understood to support such combination and modifications to achieve the benefits described above.

The invention claimed is:

1. A system for subsea operations, comprising:

a well adapter to be associated with a production or monitoring well, wherein the well adapter is configured to receive a cap for capping the production or monitoring well, is configured to receive a valve package, and is configured to allow flow of production fluids therethrough, from the production well to the valve package.

2. The system of claim 1, further comprising:

one or more of an Xmas tree, a lower riser package (LRP), and an emergency disconnect package (EDP) to form the valve package.

3. The system of claim 1, further comprising:

access ports in the well adapter to allow communication equipment, downhole pressure transducers (DHPTs), or monitoring equipment to access the production or monitoring well.

4. The system of claim 1, further comprising:

a passthrough feature of the well adapter to allow water to flow independent of gas from a methane hydrate layer of the production or monitoring well.

5. The system of claim 1, further comprising:

an alignment frame to form part of the well adapter and to comprise controls for operation by a remotely operated vehicle (ROV).

6. The system of claim 1, further comprising:

a wellhead coupler to be part of the well adapter and to sit over a wellhead housing of the production or monitoring well; and dogs within the wellhead coupler to lock against grooves of an outer diameter of the wellhead housing.

7. The system of claim 1, further comprising:

a tubing associated with the well adapter, the tubing to be within a casing hanger of the production or monitoring well.

8. The system of claim 1, further comprising:

a tubing hanger to be associated with a wellhead housing of the production or monitoring well, the tubing hanger to receive the well adapter that is stabbed connected using an open water intervention riser system (OWIRS).

9. The system of claim 1, further comprising:

a tubing hanger to be associated with the well adapter and with a tubing, the tubing to be within a casing hanger of the production or monitoring well.

10. A well adapter configured to be associated with a production or monitoring well, the well adapter further configured to receive a cap for capping the production or monitoring well and further configured to receive a valve package to allow flow of production fluids therethrough, from the production well to the valve package.

11. The well adapter of claim 10, further comprising one or more of:

access ports in the well adapter to allow communication equipment, downhole pressure transducers (DHPTs), or monitoring equipment to access the production or monitoring well;

a passthrough feature of the well adapter to allow water to flow independent of gas from a methane hydrate layer of the production or monitoring well; or an alignment frame to form part of the well adapter and to comprise controls for operation by a remotely operated vehicle (ROV).

12. A method for subsea operations, comprising:

enabling a well adapter to be associated with a production or monitoring well; and associating a cap or a valve package with the well adapter, the cap to allow capping of the production or monitoring well and the valve package to receive a flow of production fluids there through, from the production well and through the well adapter.

13. The method of claim 12, further comprising:

enabling the valve package using one or more of an Xmas tree, a lower riser package (LRP), and an emergency disconnect package (EDP).

14. The method of claim 12, further comprising:

enabling access ports in the well adapter to allow communication equipment, downhole pressure transducers (DHPTs), or monitoring equipment to access the production or monitoring well.

15. The method of claim 12, further comprising:

providing a passthrough feature of the well adapter to allow water to flow independent of gas from a methane hydrate layer of the production or monitoring well.

16. The method of claim 12, further comprising:

providing the well adapter with an alignment frame that comprises controls for operation by a remotely operated vehicle (ROV).

17. The method of claim 12, further comprising:

enabling a wellhead coupler to be part of the well adapter and to sit over a wellhead housing of the production or monitoring well; and providing dogs within the wellhead coupler to lock against grooves of an outer diameter of the wellhead housing.

18. The method of claim 12, further comprising:

associating a tubing with the well adapter, the tubing to be within a casing hanger of the production or monitoring well.

19. The method of claim 12, further comprising:

associating a tubing hanger with a wellhead housing of the production or monitoring well, the tubing hanger to receive the well adapter that is stabbed connected using an open water intervention riser system (OWIRS).

20. The method of claim 12, further comprising:

associating a tubing hanger with the well adapter and with a tubing, the tubing to be within a casing hanger of the production or monitoring well.

* * * * *